United States Patent [19]

Friedman

[11] 3,989,217

[45] Nov. 2, 1976

[54] ADJUSTABLE WIRE ENTRANCE HANGER FOR A TRAFFIC SIGNAL

[76] Inventor: Jack J. Friedman, 1025 SE. 5th St., Hialeah, Fla. 33010

[22] Filed: Jan. 23, 1975

[21] Appl. No.: 543,316

Related U.S. Application Data

[63] Continuation-in-part of Ser. No. 493,021, July 30, 1974, Pat. No. 3,916,265.

[52] U.S. Cl. ..... 248/327; 248/61; 248/295

[51] Int. Cl.[2] ..... B42F 13/00

[58] Field of Search ..... 174/38, 40 R, 41, 43, 174/44, 45, 52 R, 61–63; 240/67, 68, 73 BA, 52 R; 340/22, 84, 87, 110–112, 119; 248/317, 323, 327, 328, 333, 336, 337, 339–342, 344, 295, 17, 59, 61; 116/63 R

[56] References Cited

UNITED STATES PATENTS

| | | | |
|---|---|---|---|
| 733,356 | 7/1903 | Hess | 248/337 |
| 1,403,935 | 1/1922 | Beer | 240/52 R |
| 1,564,029 | 12/1925 | Smith | 248/317 |
| 1,577,163 | 3/1926 | Berger | 248/295 |
| 1,594,742 | 8/1926 | Lord | 340/84 |
| 1,770,272 | 7/1930 | Horni | 248/317 |
| 2,054,887 | 9/1936 | Seyler | 248/342 |
| 2,925,458 | 2/1960 | Lester | 340/119 X |
| 3,033,978 | 5/1962 | Van Dusen | 248/327 X |
| 3,495,796 | 2/1970 | Fruh | 248/327 |

*Primary Examiner*—Lawrence J. Staab

[57] ABSTRACT

An adjustable length traffic signal hanger for suspending a traffic signal, the hanger being composed of two members in sliding contact with one another and adapted to be extended or retracted and locked into a position, the hanger terminating at the lower end in a side opening pocket which communicates with a terminal end pocket to accommodate wires to electrically energize a traffic signal housing and means for connecting a traffic signal housing to the end of the hanger in covering relation of the lower end and an anti-sway member for use in combination with a cable.

4 Claims, 3 Drawing Figures

ADJUSTABLE WIRE ENTRANCE HANGER FOR A TRAFFIC SIGNAL

This is a continuation-in-part of co-pending application Ser. No. 493,021, filed July 30, 1974, now U.S. Pat. No. 3,916,265.

FIELD OF THE INVENTION

This invention relates to a hanger for a traffic signal, and, more particularly, to an improved traffic signal hanger.

BACKGROUND OF THE INVENTION

This invention has as an object a provision of an extendible length hanger which is simple and inexpensive to manufacture and which constitutes an improvement on the existing hangers for traffic signals heretofore known or employed, as is more fully set forth hereinafter.

In accordance with the foregoing general object, the instant invention will now be described with reference to the drawings.

DESCRIPTION OF A PREFERRED EMBODIMENT OF THE INVENTION

Figure 1:
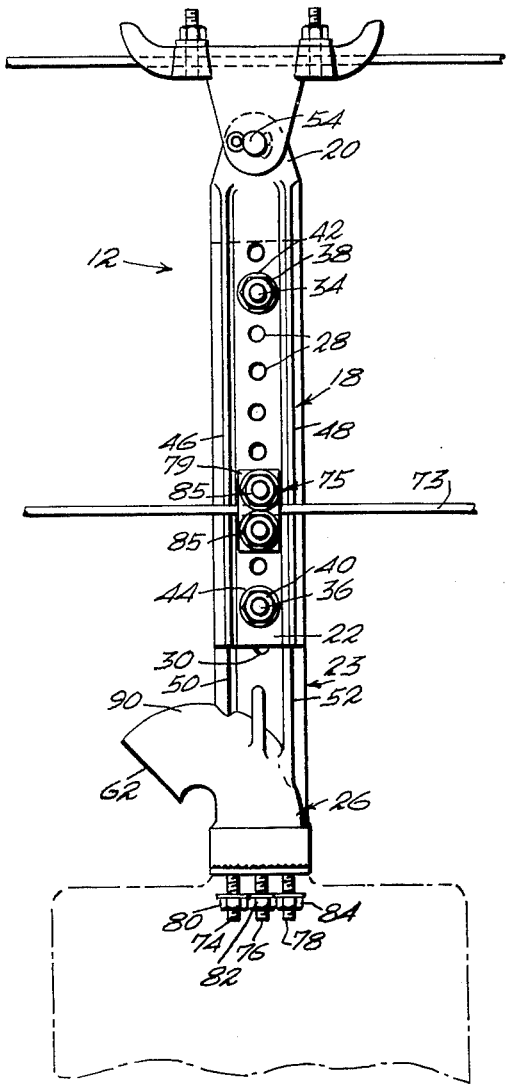
FIG. 1 is a side elevational view of the adjustable length traffic signal hanger of the present invention.
Figure 2:
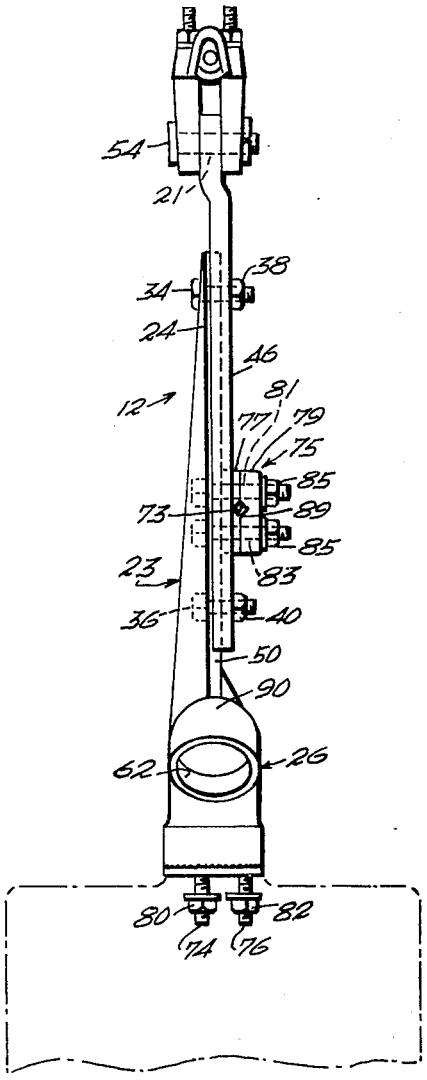
FIG. 2 is an edge view of the hanger of FIG. 1.
Figure 3:
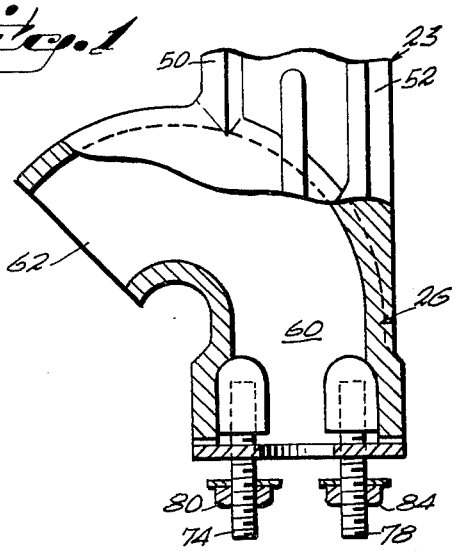
FIG. 3 is an enlarged view of the lower end of the hanger as seen in FIG. 1, shown partially in section.

Referring to the drawings, wherein like reference characters designate like or corresponding parts throughout the several views, and referring particularly to FIG. 1, the numeral 12 generally designates an extendible signal hanger. Referring specifically to the hanger, it is seen to include (a) a first elongate member 18 with an upper end and a lower end 20 and 22 and (b) a second elongate member 23 with an upper end 24 and a lower end 26. Along the length of the elongate members a plurality of holes, such as that designated by the numerals 28 and 30 are provided, the holes being equispaced along the length of the members and adapted to register with one another to vary the length of the hanger and to be secured together in a selected overall length by means of through bolts 34 and 36 and secured by means of nuts 38 and 40 with lock washers 42 and 44 being utilized as desired. The longitudinally-extending edges 46 and 48 of the first member and 50 and 52 of the second member are preferably V-shaped as seen in cross-section and are of companionate or mating size for nesting, sliding, land and groove relation upon extensible movement of the members relative to one another, the said longitudinally-extending edges also serving as rigidifying means for the hanger members. Means are provided on the upper end 20 in the form of a hole 21 for pivotal connection as at 54 with a cable engaging member. In the preferred embodiment of the hanger illustrated, the lower end 26 defines a housing terminating at an axially facing opening 60 and including a side opening pocket 62 in communication in the housing with the axial opening to accommodate passage of electrical leads. Means are provided on the terminal end to connect to a traffic signal housing, the means being in the form of a plurality of axially-extending threaded studs, such as 74, 76 and 78, and nuts 80, 82 and 84. In the preferred embodiment hood means 90 are provided to protectively cover the side opening pocket from the elements.

In the preferred embodiment clamp means are also provided intermediate the hanger length for connection of it to a stabilizing cable. The clamp means, which are designated by the numeral 75, are preferably composed of a pair of blocks, a first block 77 and a second block 79, each of which has holes extending laterally therethrough as at 81 and 83 to receive bolts, nuts and lock washers as at 85. Each of the blocks of the clamp has a groove in mating relation with one another to receive a stabilizing cable indicated by the numeral 73, and said groove being indicated by the numeral 89, whereby the same may be tightened securely to the hanger members and clamp as illustrated.

In use, the hanger length is adjusted and secured in position with the hanger being pivotally connected to the hole at the upper end thereof and, if desired, stabilized by use of the clamp means to clamp it relative to a stabilizing cable and a traffic signal housing for connection to the threaded studs on the lower end, with the electrical leads extending into the housing at the lower end of the hanger and into the pocket and thence being connected to the traffic signal proper.

It is thus seen that there has been provided an adjustable wire entrance hanger which provides stability of the span wire concept which prevents excessive swaying of a signal and which is adjustable in increments depending upon the hole spacing along the length thereof which allows for quick installation without pipe cutting, threading and rethreading into the lower portion which has the housing for electrical connection to an electric traffic signal and which is provided with the tri-stud arrangement and preferably with the serrations indicated in the drawings for positive locking.

What is claimed is:

1. An adjustable length traffic signal hanger for suspension on a cable including, in combination, a cable engaging member and a hanger, said hanger comprising a first elongate rigid member having an upper end and a lower end, said upper end having a lateral through hole receiving a pin therethrough and suspending said hanger on said cable engaging member, a second elongate rigid member having an upper end and a lower end, said lower end of said second elongate rigid member terminating in an axially downwardly facing opening and including a side opening pocket in communication with the axial opening to accommodate passage of electrical leads, means on the lower end of said second member to connect to a traffic signal housing, hood means to protectively cover the side opening pocket from the elements, said first and said second rigid members each extending from their respective upper and lower ends in overlapped relation of their respective lower and upper ends, and each of said members having a plurality of equi-spaced holes along the length thereof adapted to register in aligned relation on sliding movement of the members to extend or contract the overall hanger length between the lateral through hole and the housing, means to keep the first and second members in a selected position of adjusted length, and clamp means being provided on said hanger intermediate said axially downwardly facing opening and said lateral through hole to connect to a stabilizes cable and means to connect said clamp means to said hanger at selected locations along the length thereof, said clamp means including a through opening with a centerline perpendicular to said lateral through hole and the longitudinal axis of said hanger, said through opening being adapted to receive a stabilizer cable to limit movement in response to sway forces.

2. The improvement as set forth in claim 1 wherein rigidifying means are provided to strengthen the hanger.

3. The device as set forth in claim 1 wherein said means to connect to a traffic signal housing comprise a plurality of axial extending threaded studs peripherally arranged on and extending from said axially downwardly facing opening.

4. The device as set forth in claim 1 wherein guide means are provided on the confronting overlapped faces of the elongate rigid members for interconnection of said members and to accommodate sliding movement of extension or retraction thereof, said guide means comprising longitudinally extending raised land means along one of the members and mating longitudinally extending groove means along the other of said members.

* * * * *